United States Patent [19]

Gandini

[11] Patent Number: 4,918,769

[45] Date of Patent: Apr. 24, 1990

[54] FLUSH TANK FOR A WATER CLOSET HAVING SELF CONTAINED WASHING MEANS

[75] Inventor: Luigi Gandini, Cernusco Lombardone, Italy

[73] Assignee: American Standard Inc., New York, N.Y.

[21] Appl. No.: 335,256

[22] Filed: Apr. 10, 1989

[51] Int. Cl.[5] ..... A47K 17/00; E03C 00/00

[52] U.S. Cl. ..... 4/661; 4/363; 4/365

[58] Field of Search ..... 4/363, 341, 364, 661, 4/300.2, 340, 342, 346, 365, 415

[56] References Cited

U.S. PATENT DOCUMENTS

| | | | |
|---|---|---|---|
| 2,434,399 | 1/1948 | Duckenfield | 4/364 |
| 2,495,498 | 1/1950 | Allard | 4/341 |
| 2,545,338 | 3/1951 | Bowden | 4/341 |
| 3,392,407 | 7/1968 | Booth | 4/341 |
| 3,735,428 | 5/1973 | Olivero | 4/341 |

FOREIGN PATENT DOCUMENTS

| | | | |
|---|---|---|---|
| 2062043 | 5/1981 | United Kingdom | 4/363 |

*Primary Examiner*—Henry K. Artis

*Attorney, Agent, or Firm*—John P. Sinnott

[57] ABSTRACT

A flush tank, having a vertically extending wall positioned between the two vertical side walls to provide a first chamber which is filled with flush water and a second chamber which houses a removable washing means, is disclosed. The washing means is operatively coupled to water supply for the toilet and includes manually operated valve means to regulate the flow of wash water to cleanse the toilet bowl as needed.

6 Claims, 2 Drawing Sheets

FLUSH TANK FOR A WATER CLOSET HAVING SELF CONTAINED WASHING MEANS

BACKGROUND OF THE DISCLOSURE

Field of the Invention

The invention relates to a flush tank for a water closet and, more particularly, to a flush tank having self-contained washing means disposed in chamber adjacent to the water-filled chamber of the flush tank.

Summary of the Invention

An object of this invention is to provide a flush tank which houses a removable brush capable of delivering a stream of water, so that the cleaning operation of the corresponding toilet bowl is more practical, easier and faster and, at the same time, the same stream of water acts to keep the brush clean, with obvious advantages.

Another object of the invention is to provide a flush tank having a storage chamber which houses a built-in brush, which is ready for use when removed therefrom.

A further object of the invention is to provide a flush tank having a built-in brush which is concealed when not in use and, when stored, does not detract from the appearance of the flush tank.

These objects and other objects of the invention are attained in the context of a design solution which is simple and rational and which is inexpensive.

The washing means housed in the second chamber is preferably in the form of a brush and is supported by a hatch or a pivotally mounted wall so that as the latter is opened, the brush, simultaneously, is ready for use.

In addition, the brush has a longitudinal pipe which is open at one end into the region of the brush where the cleaning filaments or bristles are provided while, at the other end, it is connected to a flexible tube which, in turn, is connected to a water supply conduit, for example, the same conduit which supplies water to the tank. The flexible tube is preferably wound onto an automatic rewinding device, for example, accommodated in the hollow base of the water closet, such that the brush can be carried to the desired point and, when the cleansing operation is completed, the tube is automatically pulled back onto the winding device after the brush is replaced. Lastly, suitable valve means associated with the brush is provided, which is shiftable between its closed and open positions to permit the flow of water to cleanse the bowl when needed.

It is generally contemplated, according to the invention, to provide a flush tank assembly which is mounted in fluid communication with the flush water inlet opening of a water closet. The flush tank is integrally formed into two adjacent compartments; a first compartment to contain the flush water, and a second compartment which houses the self-contained washing means and has a removable hatch or door, for example, a pivotally mounted side wall of the flush tank which swings outward to provide easy access to the washing means when it is to be used.

BRIEF DESCRIPTION OF THE DRAWINGS

The design characteristics and merits of the invention will be more clearly explained in the course of the detailed description which follows, given with reference to the attached FIGURES in which.

DETAILED DESCRIPTION OF THE PREFERRED EMBODIMENT

Figure 1:
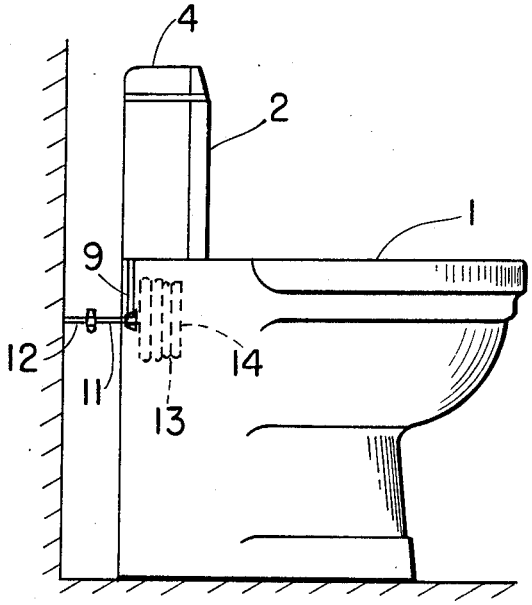
FIG. 1 is a schematic view, in elevation, of a tank mounted to a toilet bowl, according to the invention.
Figure 2:
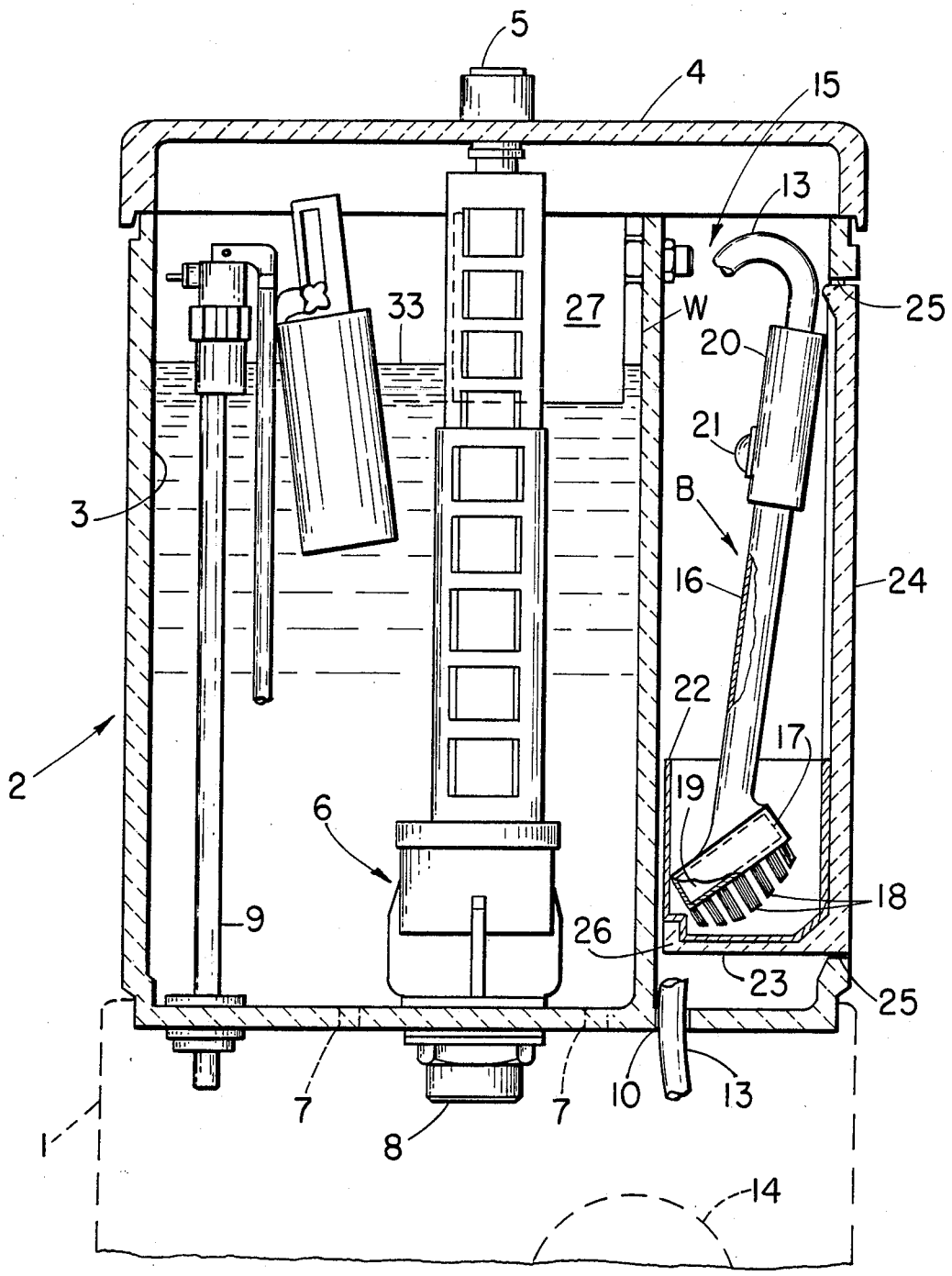
FIG. 2 is a sectional view, in elevation, illustrating the invention housed in a compartment of a flush tank.

The aforesaid FIGURES, especially FIG. 1, show a toilet bowl or water closet 1 of the type equipped at the top with an attachment and a support seat for flush tank 2. Tank 2 comprises a hollow body defined by vertical back and side walls and a front wall shaped, for example, in three sections so that, in plan view, the flush tank is in the form of a pentagon. An integrally formed vertical wall W provides a partition to separated chambers 3 and 15. Flush tank 2 includes a first chamber 3 to contain flush water 33, and a second chamber 15 to house washing means or brush assembly B.. As illustrated in FIG. 2, flush tank 2 is open at the top and has a cover 4 having a standard pushbutton or pull lever 5 mounted therein which is coupled to a standard type flush valve 6. Flush tank 2 is provided with two through holes 7 which house bolts to mount the latter to bowl 1. A central hole is provided with a union 8 which couples flush valve 6 to flush water opening, not shown, formed in toilet bowl 1 so that flush water 33 drains into the flange or flush rim of bowl 1.

An opening formed in the bottom wall of first chamber 3 is provided to mount water control assembly 9, the lower end of which is connected to water supply conduit 12, as shown in FIG. 1. Opening 10 formed in the bottom wall of chamber 15 is provided to mount flexible tube or hose 13 to washing means B at one end thereof, and to water supply conduit 12 at its other end.

Water control assembly tube 9 is connected to T-shaped fitting 11 forming part of water supply tube 12. The second outlet opening of T-shaped fitting 11 is coupled to flexible tube 13, which is wound onto an automatic rewinding device 14 housed in the hollow portion formed in the rear of bowl 1, FIGS. 1 and 2.

Rewinding device 14 and the respective hydraulic connection to T-shaped fitting 11 and flexible tube 13 are not shown because they are ordinary and easily understood by persons skilled in this art. Flexible tube 13, FIGS. 2 and 3, passes through opening 10 and enters chamber 15 in the body of tank 2, and extends along wall W. The downstream end of flexible tube 13 is connected to the hollow handle of brush 16 which ends in a hollow cleaning element 17. The latter is equipped with a plurality of tufts 18 of filaments which are interspersed with cleaning water delivery holes 19. The flow of water directed to holes 19 is interrupted by a valve 20 which is equipped with an opening pushbutton 21, and which is mounted to the upper end of the handle of brush 16.

Valve 20 has not been shown in detail since it is known in the art.

As illustrated, there is provided for brush 16 a container housing 22 which is positioned against the lower edge of hatch or side wall 24 and immovably mounted on bracket 23. Side wall 24 is hingedly mounted to tank 2 by means of a vertical shaft 25 at the rear wall of tank 2, see FIG. 3. Provided between housing 22, bracket 23 and hatch 24 is latch means 26 to retain housing 22 in position by a slight pressure.

Figure 3:
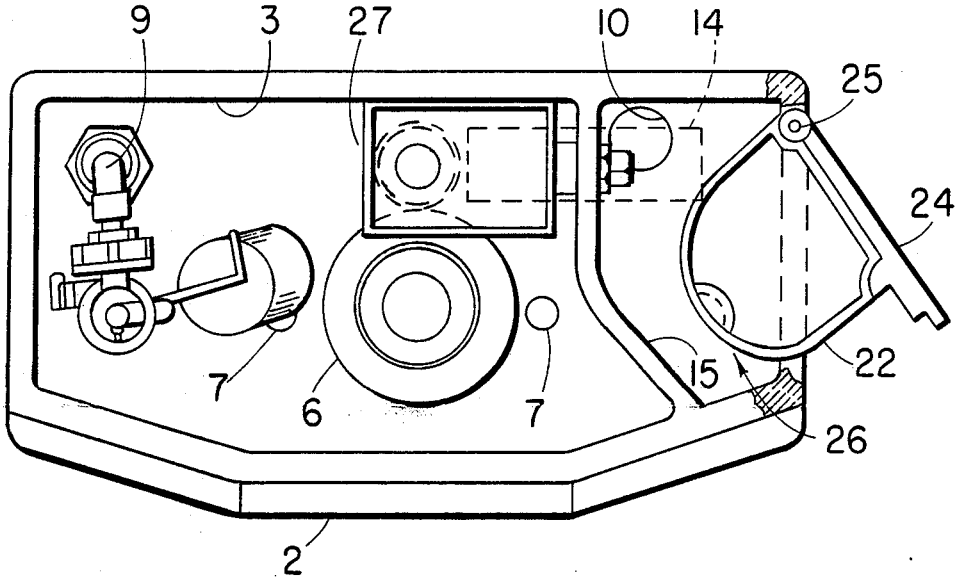
FIG. 3 is a top plan view of FIG. 2, in which the cover and brush have been removed and the pivotally mounted side wall concealing the brush is open.

Also, it should be noted, see FIGS. 2 and 3, that mounted on the upper part of tank 2 is a small container 27, the bottom of which is located at a lever slightly lower than the maximum filling level of flush water 33. Container 27 is designed to accommodate an ordinary deodorant/cleansing product, and at the bottom of container 27 is at least one opening to allow the water designed to dissolve said product to pass through, and to drain this water when chamber 3 empties.

It is claimed:

1. A flush tank assembly which is adapted to be mounted in fluid commnication with the flush water inlet opening of a toilet bowl comprising:

a flush tank having a vertically extending partition wall positioned between the two vertical side walls of said tank to form a first chamber which houses a water control and flush valve assembly and is adapted to discharge flush water into the toilet bowl, and a second chamber which houses a removably mounted washing means;

said washing means including a manually-operated valve means operatively coupled to said washing means to control the flow of wash water therethrough;

and a flexible conduit coupled between said water inlet source and said washing means so that when said washing means is removed from said second chamber, wash water is manually regulated through said washing means to cleanse the toilet bowl as needed.

2. The flush tank assembly, according to claim 1, wherein said washing means is a brush having a handle coupled to the brush, said handle and brush having a water passage formed therein and a manually-operated valve means mounted in said passage to control the flow of water therethrough.

3. The flush tank assembly, according to claim 1, wherein said washing means includes a rewinding device mounted exteriorly from said second chamber and adjacent thereto, with said flexible tube being wound thereon, one end of said flexible tube coupled to the water inlet source and the other end coupled to the washing means.

4. The flush tank assembly, according to claim 1, wherein said side wall of the flush tank forming said compartment in hingedly mounted to its back wall to provide an access opening to remove said washing means therefrom.

5. The flush tank assembly, according to claim 4, wherein said hingedly mounted door includes support means to removably mount said washing means thereon so that when said door is opened, said washing means is ready for removal and use.

6. The flush tank assembly of claim 1 wherein said partition wall is formed integral with said back and front walls of said tank.

* * * * *